US007607542B1

(12) United States Patent
Hsieh

(10) Patent No.: US 7,607,542 B1
(45) Date of Patent: Oct. 27, 2009

(54) CONTAINER ASSEMBLY OF PALLET STRUCTURE

(76) Inventor: Chuan Pao Hsieh, No. 214, Alley 50, Lane 197, Wusheng Rd., West Central District, Tainan City, 700 (TW)

( * ) Notice: Subject to any disclaimer, the term of this patent is extended or adjusted under 35 U.S.C. 154(b) by 0 days.

(21) Appl. No.: 12/253,941

(22) Filed: Oct. 17, 2008

(51) Int. Cl.
*B65D 19/00* (2006.01)

(52) U.S. Cl. ..... 206/600; 108/56.3; 206/386; 220/4.31

(58) Field of Classification Search ..... 206/386, 206/595–600; 108/56.1, 56.3; 220/1.5, 4.28, 220/4.31, 4.33
See application file for complete search history.

(56) References Cited

U.S. PATENT DOCUMENTS 3,401,814 A * 9/1968 Chiswell et al. ..... 220/4.33
5,058,746 A * 10/1991 Morgan, IV ..... 206/597
5,593,058 A * 1/1997 Spencer et al. ..... 220/4.31
5,638,973 A * 6/1997 Dewey et al. ..... 220/4.33
7,155,865 B2 * 1/2007 Rosenberg ..... 220/4.31
2006/0169185 A1 * 8/2006 Williams, Jr. ..... 108/56.3

* cited by examiner

*Primary Examiner*—Luan K Bui
(74) *Attorney, Agent, or Firm*—Banger Shia

(57) ABSTRACT

This invention discloses a container assembly of pallet structure with portable parts, including one or more side board unit, one or more corner connectors, one or more supporting pallets, and one or more laying boards. The side board unit further includes a side board and a bottom board. The side board has stop-by-contact section extends from each of side of the side board to engage with the groove of a corner connector. The bottom of the side board engages with the pallet to form a unit, while allowing laying boards to be installed within.

2 Claims, 10 Drawing Sheets

CONTAINER ASSEMBLY OF PALLET STRUCTURE

BACKGROUND OF THE INVENTION

1. Field of the Invention

This invention relates to a tool-free size-adjustable container assembly, particularly to one firmly assembled together as a unit through specially designed pallets and boards, which dispenses with assembly tools and takes up limited storage space.

2. Description of the Related Art

Containers in the market can be divided into two kinds, one is produced as an non-separated whole unit in manufacturing, and, the other, is foldable and can be assembled in different layouts or combinations. The current invention is an improvement on the foldable kind of containers.

SUMMARY OF THE INVENTION

Compared with the prior arts, improvements in the present invention are made in the following ways.

1. When in not use, the current invention allows for easy and quick disassembling and requires only limited space for storage.
2. Flexible design of dividers allows more varieties of space divisions.
3. A grooved sectional extending from the bottom of a side board engages with the hole of the bottom board to form a single side board unit.
4. An upside-down T-shaped section at the bottom of a side board inserts into engages the hole of the bottom board to form a side board unit.
5. One or more upside-down T-shaped sectionals and one or more narrow straight-line grooves at the bottom of the side board allows for the upside-down T-shaped sectionals to move along the straight-line grooves to engage with the holes of the bottom board to form said side board unit.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENTS

Figure 1:
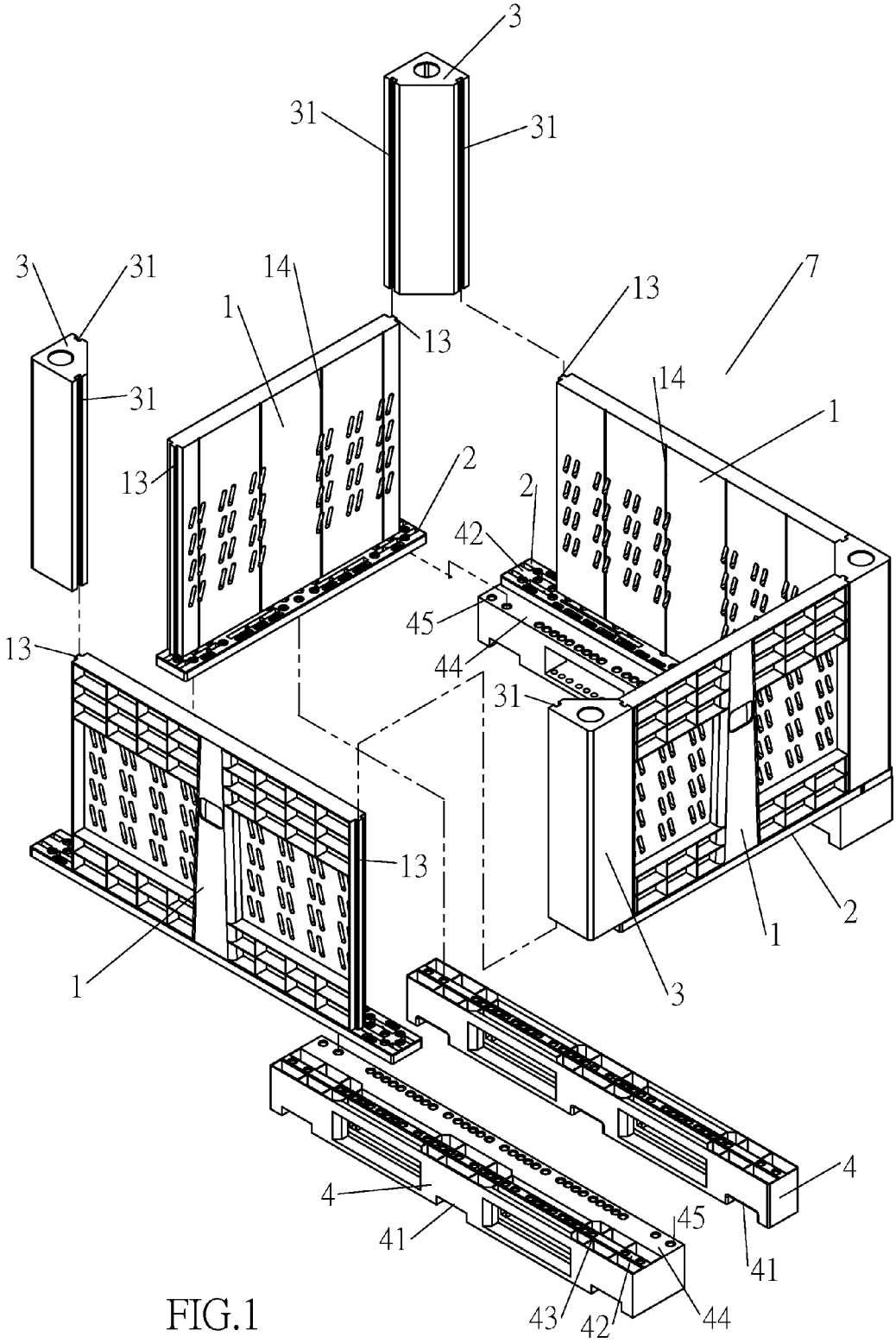
FIG. 1 is a partial exploded perspective view of the first preferred embodiment in accordance with the invention.

Parts or elements referred to in the invention with a symmetrical structure and identical functions are designated by the same reference numerals throughout the entire disclosure.

Figure 2:
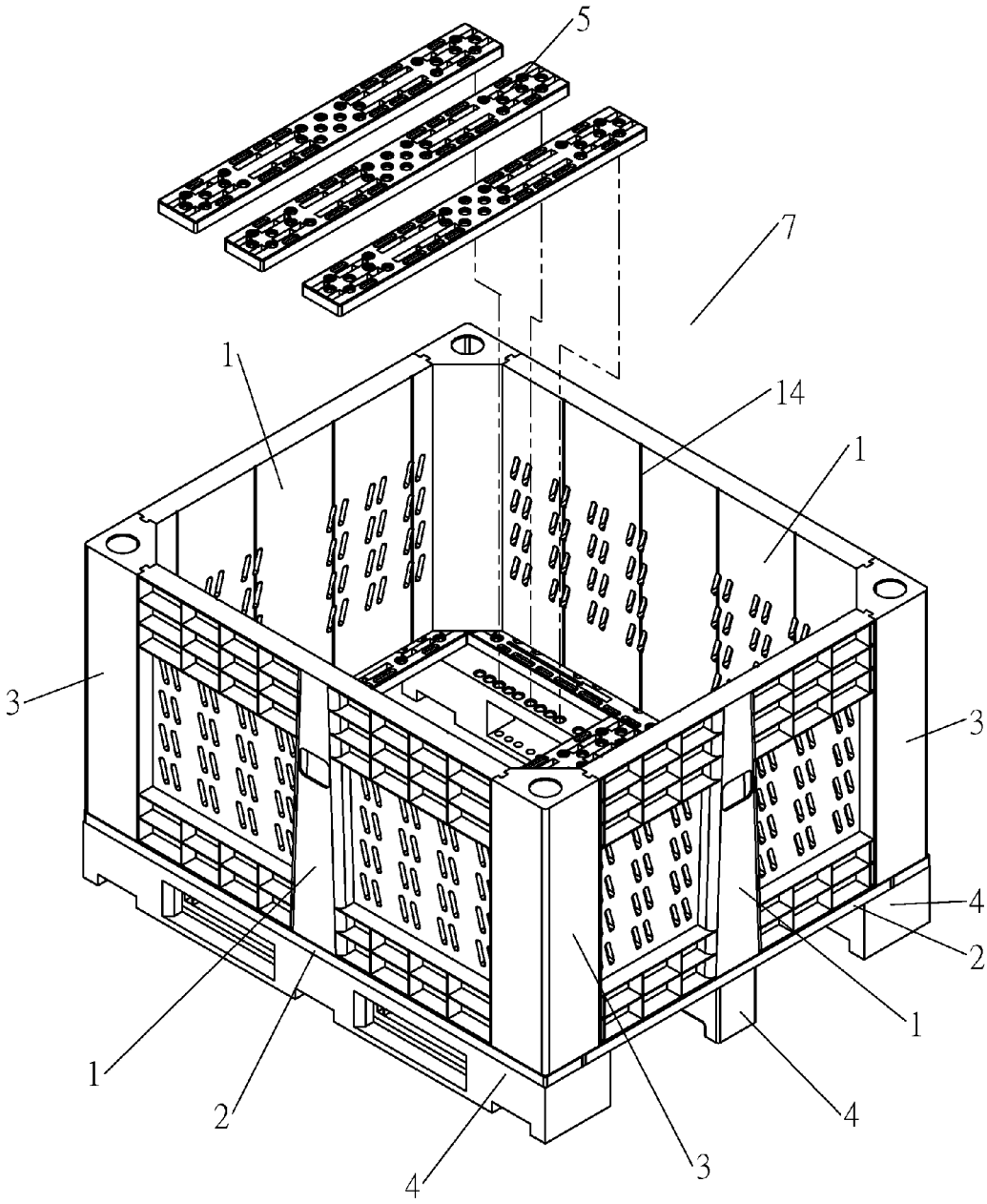
FIG. 2 illustrates the assembling of laying boards in the first preferred embodiment in FIG. 1.
Figure 4:
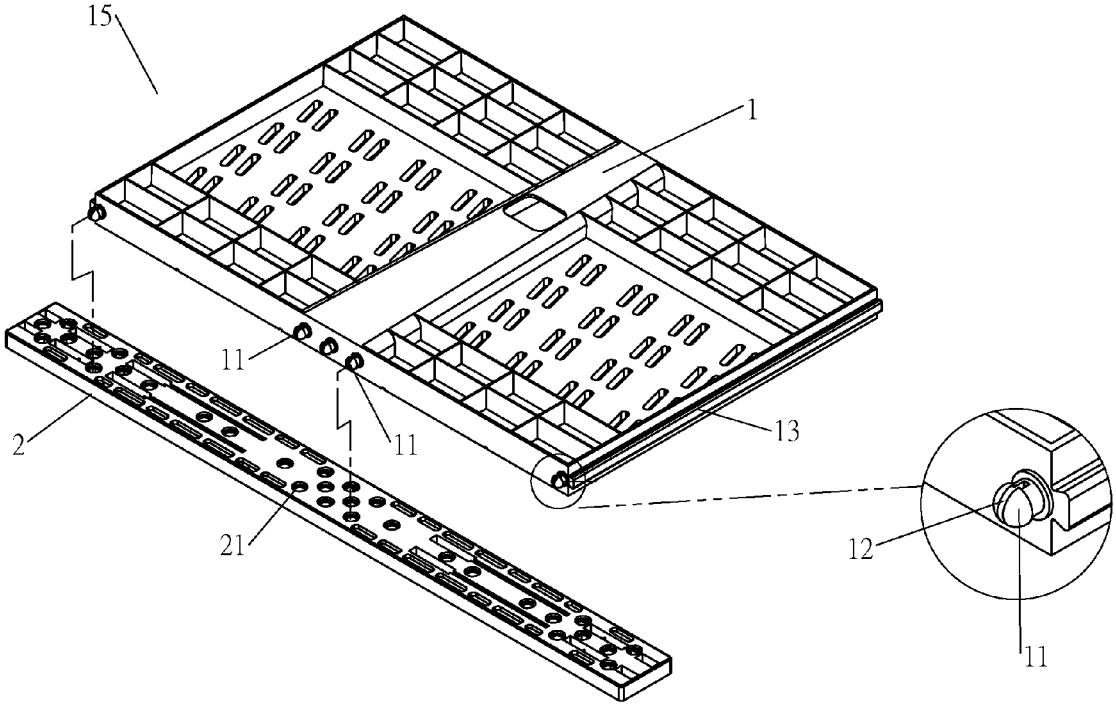
FIG. 4 shows the essential parts of the $1^{st}$ preferred embodiment of a side board unit.

Referring to FIGS. 1 and 2, the first preferred embodiment of this invention, a container body 7, includes the following parts: several side boards 1, several bottom boards 2, several corner connectors 3, several supporting pallets 4, several laying boards 5 and several dividers 6. In particular, Side boards 1: the size (width and length) and shape of side boards 1 is pre-determined based upon the preferred size of the container assembly (for instance, side boards 1 shown in FIGS. 1 and 2 are bigger in the front and back than those in the left and right side of the container assembly 7). At the bottom of the side board 1 is displaced several bulbs 11 with bulb groove 12 contained within (as shown in FIG. 4). A stop-by-contact section 13 extends from each of the two sides of the side board 1; several channels 14 facing inner side of the container body 7 are formed in fixed distances.

Bottom boards 2: as shown in FIG. 4, the width and length of bottom board 2 are set to be larger than those of the side board 1, respectively, for the former (i.e. bottom board 2) to act as a part-receiver in assembling. Some through holes 21 are included in the bottom board 2, the distance between through holes are made to correspond to that between bulbs 11 of side board 1. Preferably, several bulbous structures are formed on the side of the bottom board 2 that faces downward.

Corner connectors 3: corner connectors 3 engage side boards together in a corner position of the container assembly 7. Corner connectors include corner grooves 31 for fastening purpose.

Supporting Pallets 4: the size of holding pallets 4 are determined by that of the bottom boards 2, which rides on top of the supporting pallets 4. Several pallets feet 41 are formed at the bottom of the holding pallet 4 in a specially designed concave shape for robot hands of a stacking-up machine to easily get in. A rising section 42 is disposed on the top of the supporting pallet 4, within which are included a concave chamber 43 corresponding to the bulbous structure on the side of the bottom board 2 that faces downward. On the same side of rising section 42 and concave chamber 43 is formed a lower section 44; several pallet holes 45 are disposed within the lower section 44.

Laying boards 5: as shown in FIG. 2, the size or shape of a laying board 5 is decided by both of its four surrounding side boards and the holding pallets 4; some bulbous parts (not shown in the figures) are formed at the bottom of the laying boards 5, corresponding to pallet holes 45 of holding pallets 4.

Figure 3:
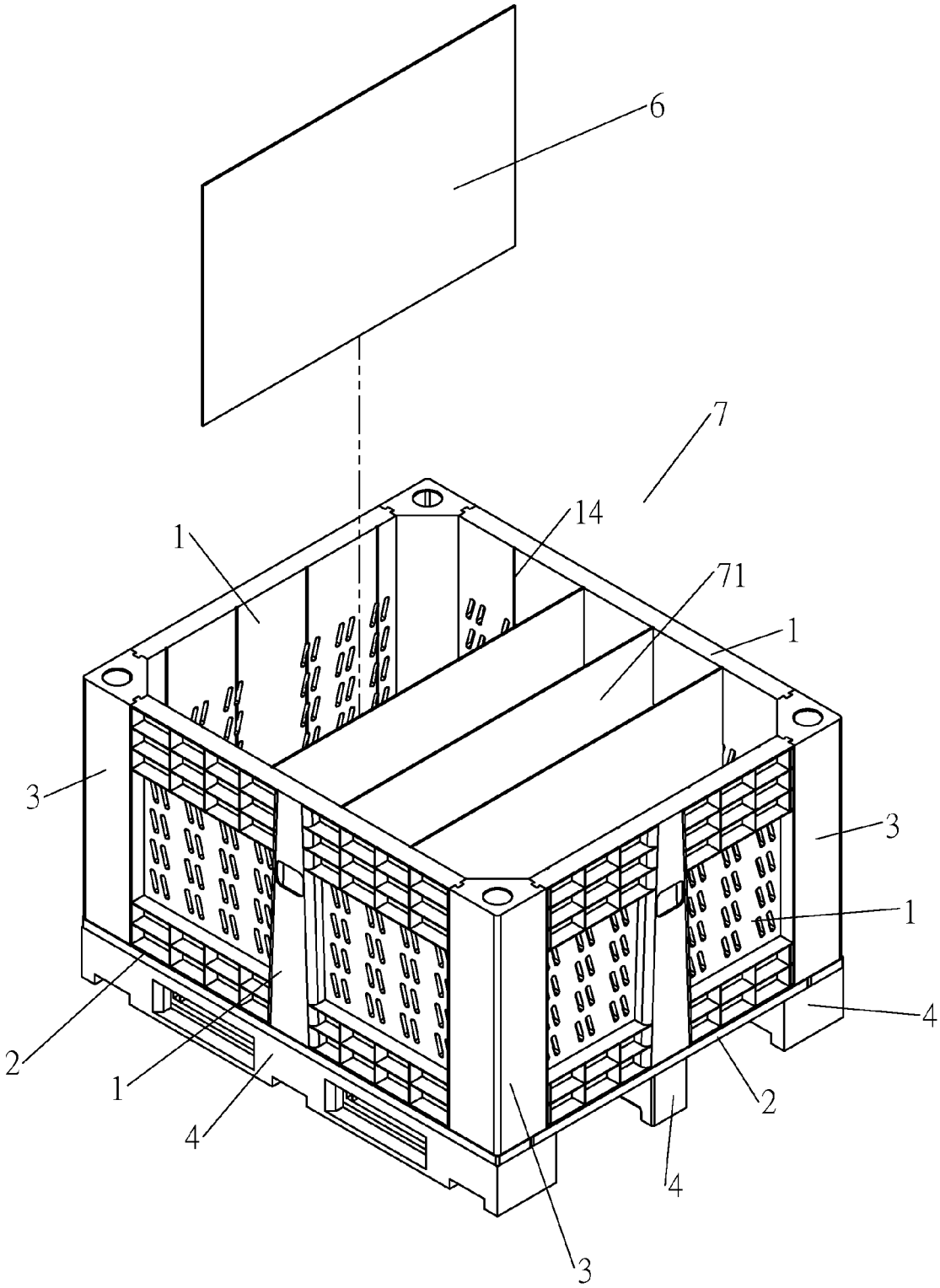
FIG. 3 illustrates the assembling of dividers in the first preferred embodiment in FIG. 1.

Dividers 6: as shown in FIG. 3, the size or shape of a divider 6 is determined by the distance between the front and the back side board, or by the distance between the left and right side board.

Figure 5:
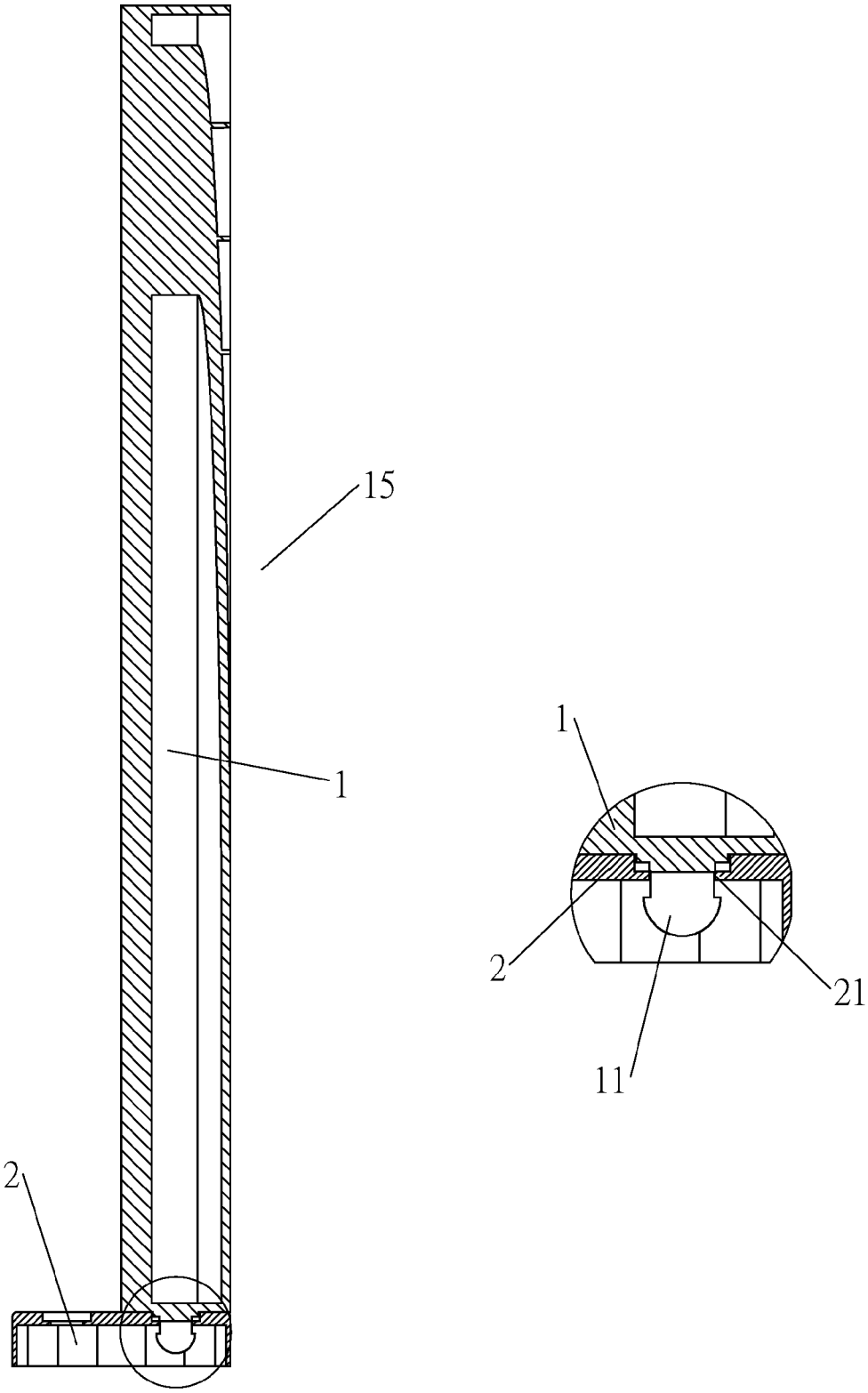
FIG. 5 is a cross-sectional view of the $1^{st}$ preferred embodiment of a side board unit.

Refer to FIGS. 1 to 3 for assembling side boards 1, bottom boards 2, corner connectors 3, holding pallets 4, laying boards 5 and dividers 6. Refer to FIG. 4 for assembling side boards 1 with bottom boards 2; bulbs 11 (with bulb groove 12) snap into the corresponding through holes 21 of bottom boards 2 to form a single side board unit 15, shown in FIG. 5. Each side board unit 15 then engages with each other by the corner connector 3; the corner connector 3 fastens with each side board unit 15 with its corner groove 31 cutting straight into the side of the sideboard unit 15, as shown in FIGS. 1 and 2. While the bulbous structures formed beneath the bottom board 2 fasten together with the concave chamber 43 of the supporting pallet 4. In the meantime, supporting pallets 4 also assemblies with the lower part of the side board unit 15, allowing for the disposition of laying boards 2 within, as shown in FIG. 2. Pallet holes 45 (in the lower section 44 of supporting pallets 4) are manufactured to correspond to the bulbous structures formed beneath the bottom board 2 for the engagement of the supporting pallets 4 and the bottom board 2. Dividers 6 may insert into the channels 14 (of two corresponding side boards 1) to serve as boundary for different chambers 71 within the container body 7.

Figure 6:
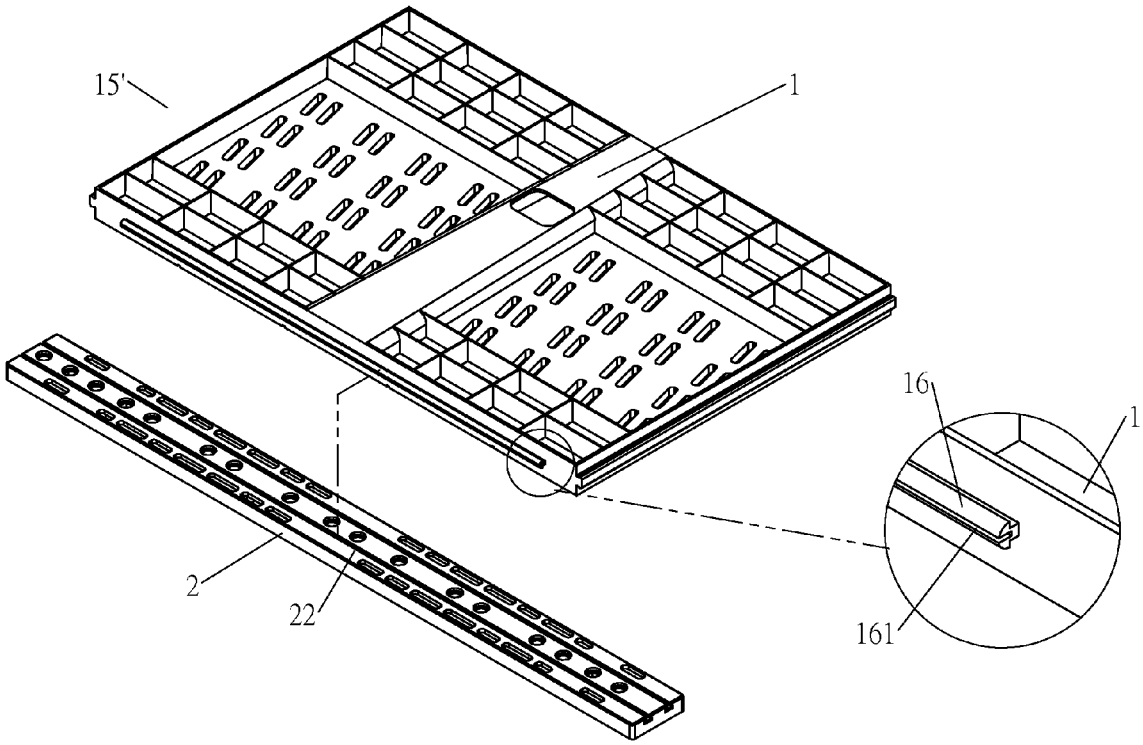
FIG. 6 shows the essential parts of a $2^{nd}$ preferred embodiment of a side board unit.
Figure 7:
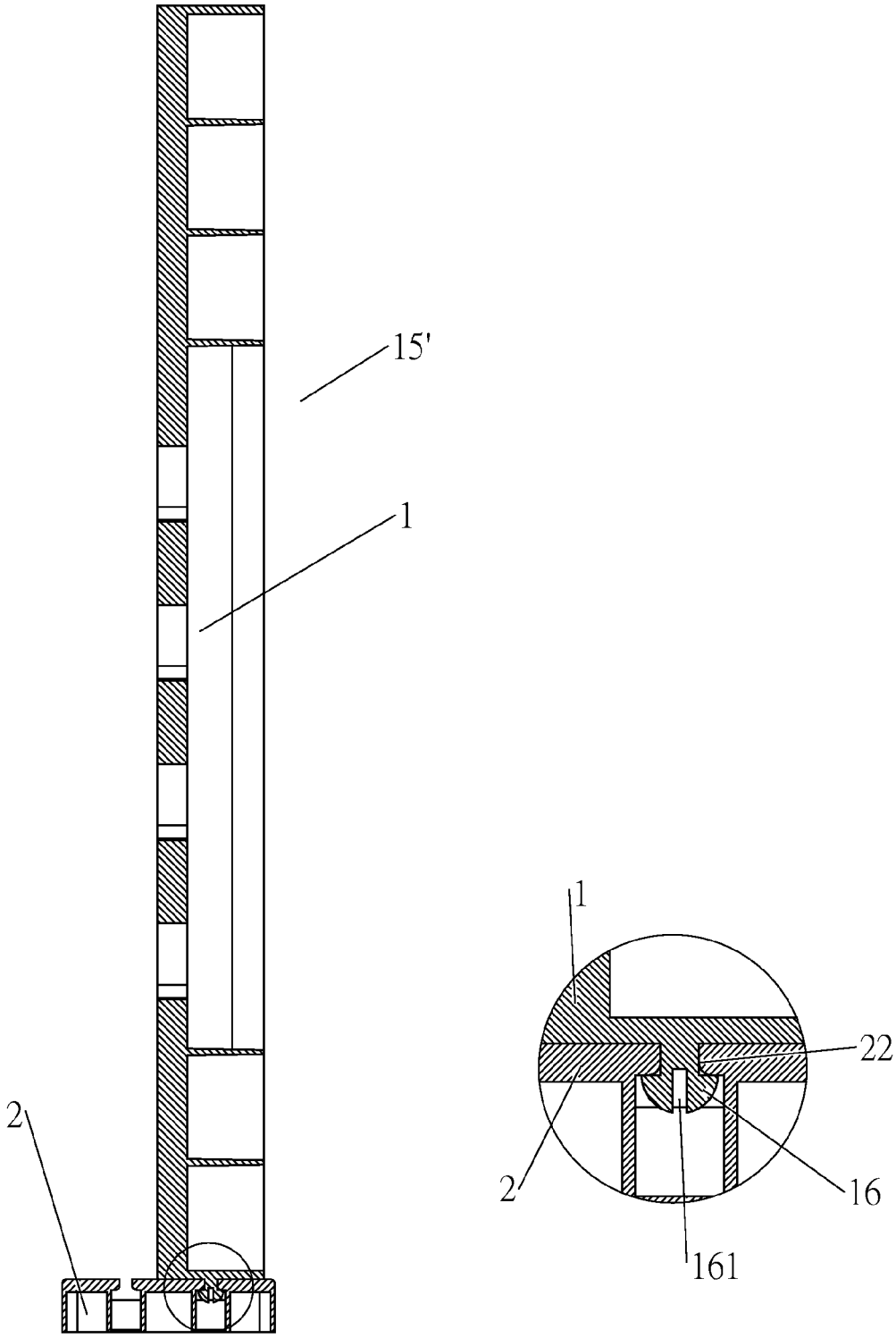
FIG. 7 is a cross-sectional view of the $2^{nd}$ preferred embodiment of a side board unit.

Referring to FIGS. 6 and 7 for a $2^{nd}$ preferred embodiment of the side board unit 15' of the present invention. The side board 1 has an extended section 16 with a groove 161, which fastens with the bottom board channel 22 (of the bottom board 2) to form a side board unit 15'.

Figure 8:
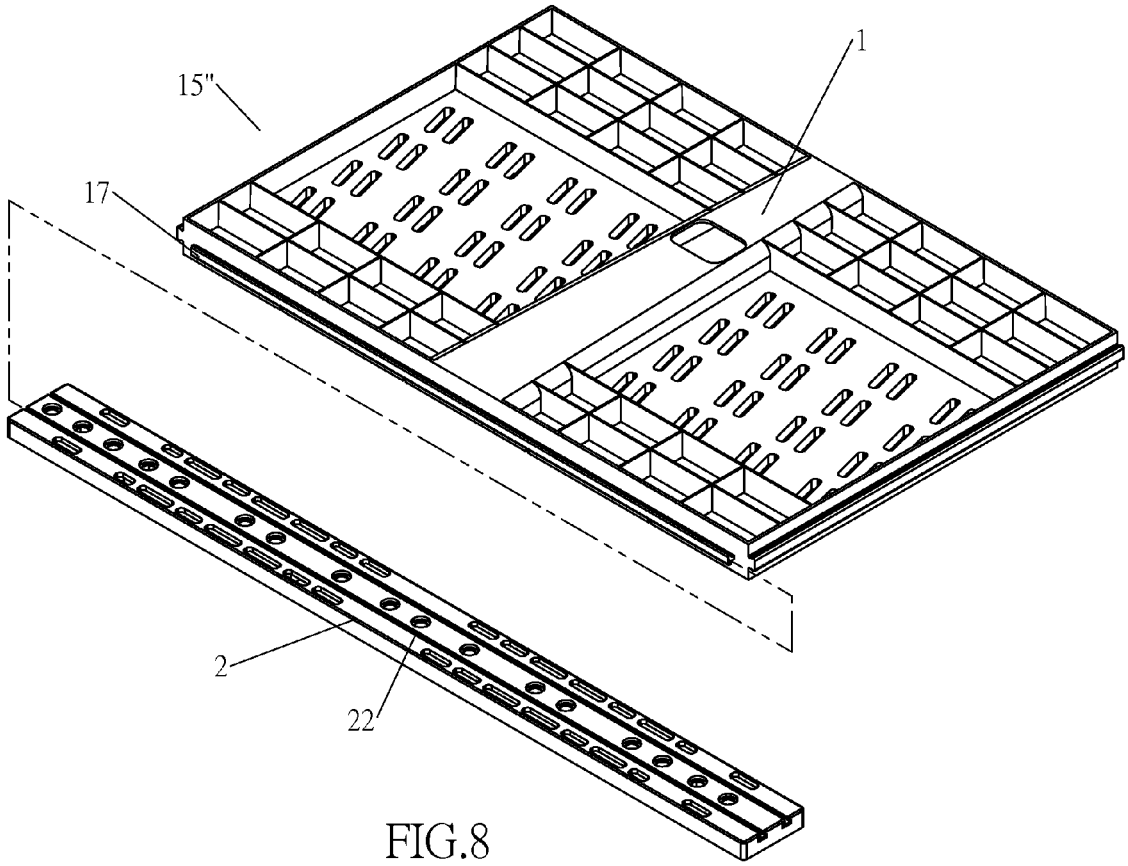
FIG. 8 shows the essential parts of the $3^{rd}$ preferred embodiment of a side board unit.
Figure 10:
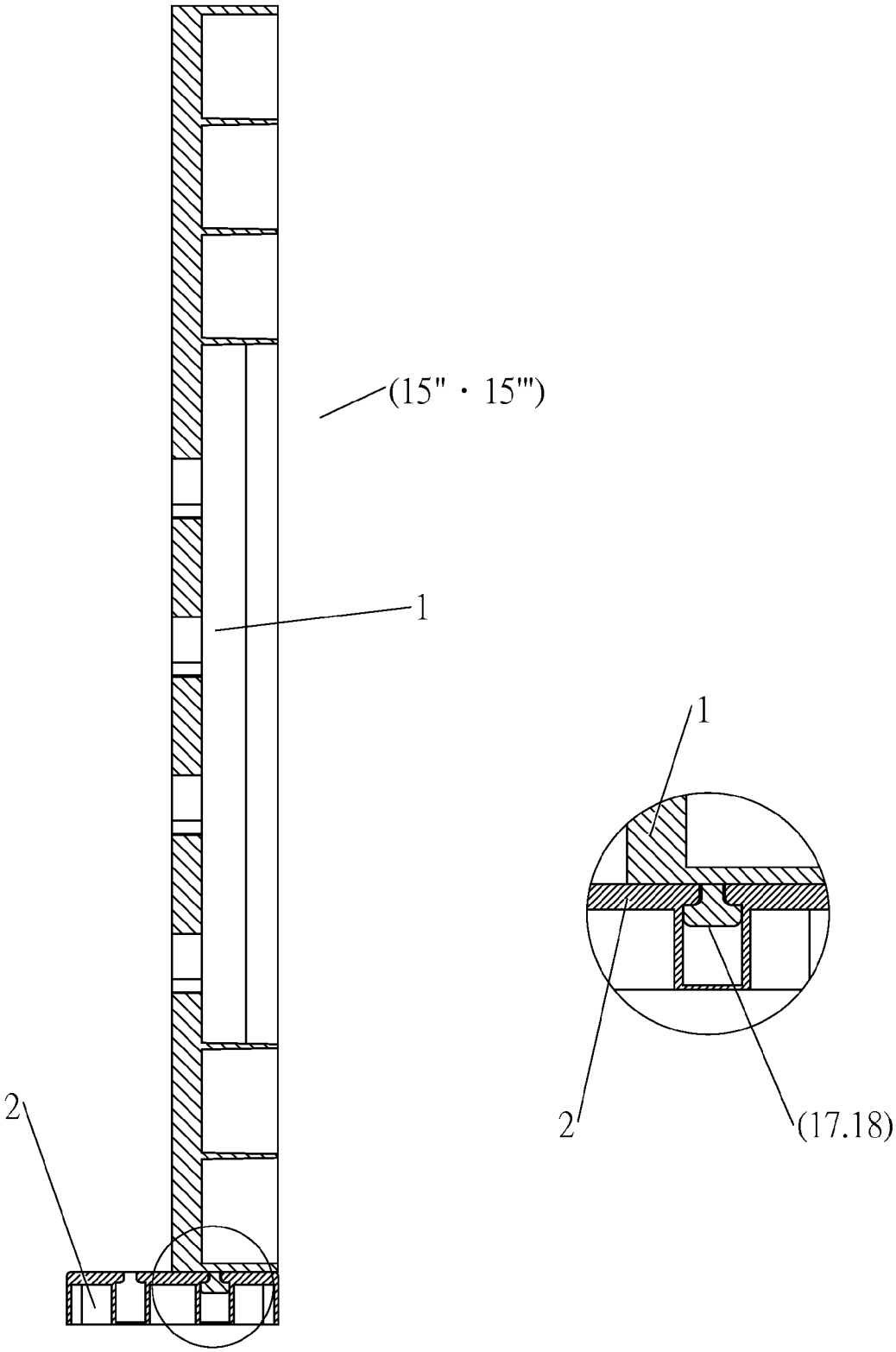
FIG. 10 includes the cross-sectional views of the $2^{nd}$ and the $4^{th}$ preferred embodiment of a side board unit.

Referring to FIGS. 8 and 10 for a $3^{rd}$ preferred embodiment of the side board unit 15" of the present invention. An upside-down T-shaped supporter 17 extends from the bottom of the side board 1, which inserts into the receiving groove 22 of the laying board 2 to form a side board unit 15".

Figure 9:
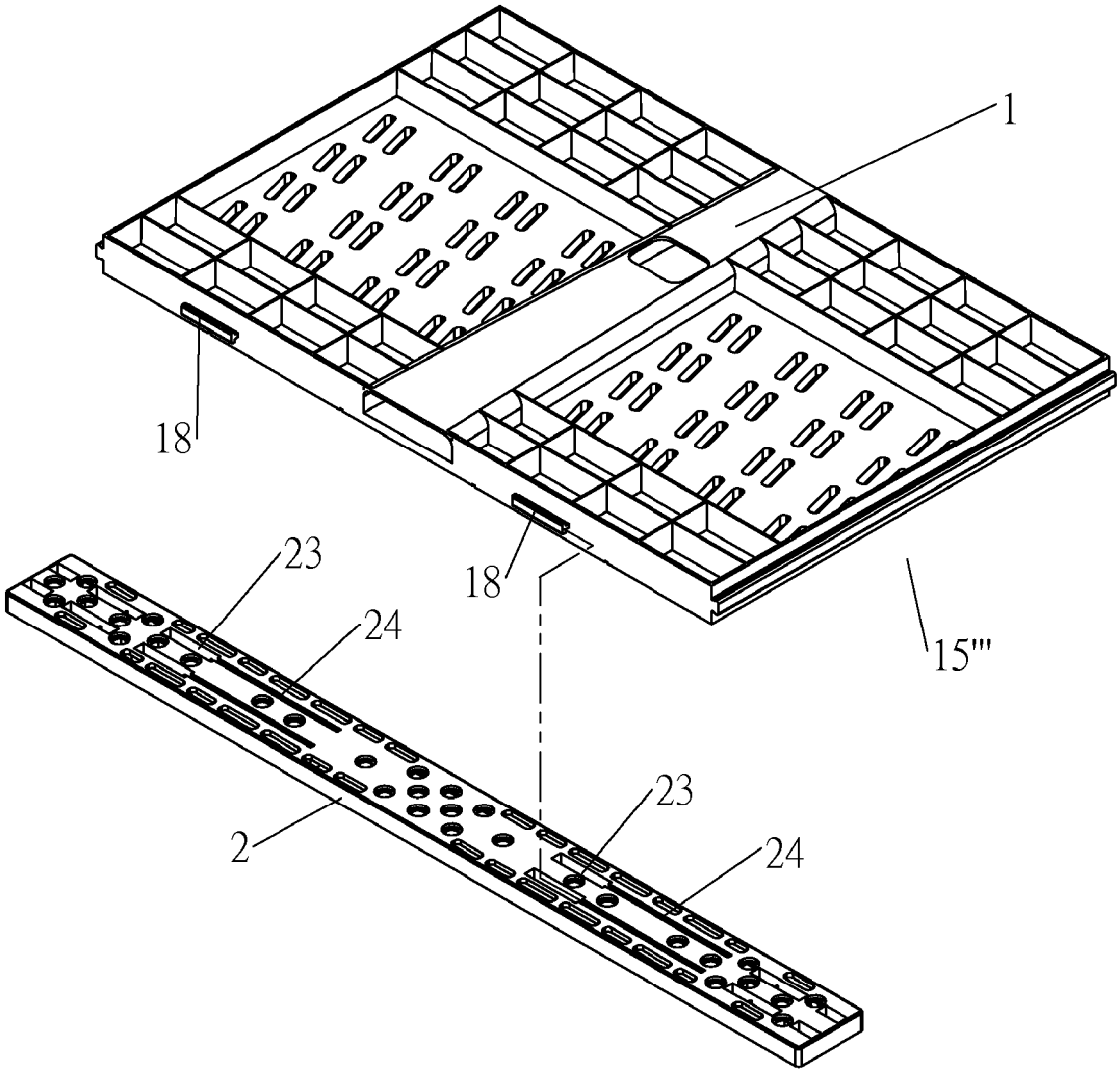
FIG. 9 shows the essential parts of the $4^{th}$ preferred embodiment of a side board unit.

Referring to FIGS. 9 and 10 for a $4^{th}$ preferred embodiment of the side board unit 15" of the present invention. Upside-down T-shaped sectionals 18 disposed at fixed distance to each other at the bottom of the side board 1, corresponding to the grooved holes 23. While upside-down-T-shape sectionals 18 move along the narrow straight-line groove 24 to get into the corresponding grooved holes 23 to form a side board unit 15'''.

Advantages associated with the current invention include:

(1) A variety way of assembling of the container creates different size and shape of the final product; the specific design of containers of boards can be taken apart easily when not in use, and will not take up space, either.

(2) Beneficial to traveling in sale, taking up limited volume in storage when boards are stacking up.

(3) Size-adjustable final product is made possible by different combination and lay-out of boards.

While the present invention has been described in connection with the most practical and preferred embodiment, it is understood that this invention is not limited to the disclosed embodiment but is intended to cover various arrangement included within the spirit and scope of the broadest interpretation so as to encompass all such modifications and equivalent arrangements.

I claim:

1. A container assembly of pallet structure, including one or more side board units, further including a side board and a bottom board, whereas said side board further includes several bulbs with groove within, a stop-by-contact section extending from each of two sides of said side board for engagement, and several channels, said bottom board includes some holes, corresponding to said bulbs of said side board for engaging purpose, and some bulbous structures facing downward;

one or more corner connectors, including corner grooves with each said corner grooves for fastening with said stop-by-contact section of said side board;

one or more supporting pallets, including several pallets feet, a rising section, a concave chamber corresponding to said bulbous structure of said bottom board for engagement, a lower section with several pallet holes;

one or more laying boards, including several bulbous parts, corresponding to said pallet holes of supporting pallets for engagement.

2. A container assembly of pallet structure as claimed in claim 1, further including one or more dividers inserting into said channels of two side boards for space division purpose.

* * * * *